US010971082B2

(12) United States Patent
Kim et al.

(10) Patent No.: US 10,971,082 B2
(45) Date of Patent: Apr. 6, 2021

(54) DATA DRIVER AND ORGANIC LIGHT EMITTING DISPLAY DEVICE INCLUDING THE SAME

(71) Applicant: LG Display Co., Ltd., Seoul (KR)

(72) Inventors: Taewook Kim, Paju-si (KR); Jungyoon Yi, Daegu (KR); Byungjae Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/587,843

(22) Filed: Sep. 30, 2019

(65) Prior Publication Data

US 2020/0168163 A1 May 28, 2020

(30) Foreign Application Priority Data

Nov. 28, 2018 (KR) ..... 10-2018-0149806

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2310/027* (2013.01); *G09G 2310/0291* (2013.01); *G09G 2320/0233* (2013.01)

(58) Field of Classification Search
CPC ..... G09G 3/3233; G09G 2320/0233; G09G 2310/0291; G09G 3/3291; G09G 2310/027
See application file for complete search history.

(56) References Cited

U.S. PATENT DOCUMENTS

2014/0092076 A1 4/2014 Lee
2015/0379909 A1* 12/2015 Yu ..... G09G 3/3258 345/690
2016/0155380 A1* 6/2016 Kwon ..... G09G 3/3291 345/78
2016/0155381 A1* 6/2016 Kwon ..... G09G 3/3233 345/215
2016/0163255 A1* 6/2016 Kim ..... G09G 3/3291 345/212

(Continued)

FOREIGN PATENT DOCUMENTS

EP 3 168 879 A1 5/2017
KR 10-2014-0071303 A 6/2014

*Primary Examiner* — Vinh T Lam
(74) *Attorney, Agent, or Firm* — Seed Intellectual Property Law Group LLP

(57) ABSTRACT

Data drivers and organic light emitting display devices having data drivers are provided in which a number of amplifiers for driving a display panel is reduced. A data driver includes an analog-to-digital converter, first and second amplifier circuits, a first switch coupled to an output of the first amplifier circuit, and a second switch and a third switch coupled to an output of the second amplifier circuit. The first switch is configured to selectively couple the output of the first amplifier circuit to a first data line and to second data line of a display panel. The second switch is configured to selectively couple the output of the second amplifier circuit to the second data line and to the analog-to-digital converter. The third switch is configured to selectively couple the output of the second amplifier circuit to a sensing line of the display panel.

20 Claims, 16 Drawing Sheets

(56) References Cited

U.S. PATENT DOCUMENTS

| | | | | |
|---|---|---|---|---|
| 2016/0163265 | A1* | 6/2016 | Yang | G09G 3/3233<br>345/690 |
| 2017/0294159 | A1* | 10/2017 | Lee | H01L 27/3248 |
| 2018/0137819 | A1* | 5/2018 | An | G09G 3/3233 |
| 2020/0013320 | A1* | 1/2020 | Yamamoto | G01R 31/2884 |

* cited by examiner

DATA DRIVER AND ORGANIC LIGHT EMITTING DISPLAY DEVICE INCLUDING THE SAME

BACKGROUND

Technical Field

The present disclosure relates to a data driver and an organic light emitting display device including the same.

Description of the Related Art

An active matrix type organic light emitting display device is a device in which pixels, each including an organic light emitting diode (OLED) and a driving thin film transistor (TFT), are arranged in a matrix form and brightness of an image formed by pixels is regulated according to gray levels of image data. The driving TFT controls a pixel current flowing in the OLED according to a voltage (hereinafter, referred to as a "gate-source voltage") applied between a gate electrode and a source electrode thereof. The amount of light of the OLED and brightness of a screen are determined according to pixel currents.

A threshold voltage, electron mobility, and the like, of the driving TFT determine driving characteristics of each pixel, and thus, they are supposed to be the same in all the pixels. However, driving characteristics of the pixels may vary due to various causes such as process characteristics, time-varying characteristics, and the like. Such a difference in driving characteristics causes a luminance deviation, which restricts implementation of a desired image. An external compensation technique of sensing driving characteristics of pixels and correcting data of an input image on the basis of sensing results is known to compensate for luminance deviation between pixels.

BRIEF SUMMARY

External compensation techniques sense driving characteristics of pixels using a current integrator included in a data driver. The related art data driver includes a plurality of integrator amplifiers for configuring a current integrator and a plurality of buffer amplifiers connected to a digital-to-analog converter (DAC). The buffer amplifiers are connected to data lines of a display panel, respectively, and output a display data voltage or a sensing data voltage to the data lines. The display data voltage and the sensing data voltage are voltages for turning on a pixel current. The integrator amplifiers are respectively connected to sensing lines of the display panel and receives a pixel current from the sensing lines.

In case of display driving, only the buffer amplifiers operate to output a display data voltage to corresponding data lines, and the integrator amplifiers do not operate. Integrator amplifiers operate only for sensing driving. In case of sensing driving, pixels connected to the same integrator amplifier cannot be sensed at the same time, and thus, only a buffer amplifier connected to one pixel outputs a sensing data voltage and a buffer amplifier connected to another pixel outputs a separate OFF voltage for turning off the pixel current.

As described above, the related art data driver requires buffer amplifiers corresponding to the number of the data lines and requires integrator amplifies corresponding to the number of sensing lines, and thus, a chip size of an integrated circuit (IC) and power consumption increase.

The present disclosure provides a data driver in which the number of amplifiers used for driving is reduced through common use of amplifiers (or amplifier sharing), and an organic light emitting display device including the same.

In at least one embodiment, the present disclosure provides a data driver that includes an analog-to-digital converter, first and second amplifier circuits, and first, second, and third switches. The first switch is coupled to an output of the first amplifier circuit, and the first switch is configured to selectively couple the output of the first amplifier circuit to a first data line of a display panel and to selectively couple the output of the first amplifier circuit to a second data line of the display panel. The second switch is coupled to an output of the second amplifier circuit, and the second switch is configured to selectively couple the output of the second amplifier circuit to the second data line and to selectively couple the output of the second amplifier circuit to the analog-to-digital converter. The third switch is coupled to the output of the second amplifier circuit, and the third switch is configured to selectively couple the output of the second amplifier circuit to a sensing line of the display panel.

In another embodiment, the present disclosure provides a display device that includes a display panel and a data driver that is coupled to the display panel. The display panel includes a first pixel circuit, a second pixel circuit adjacent to the first pixel circuit, a first data line connected to the first pixel circuit, a second data line connected to the second pixel circuit, and a sensing line connected to the first pixel circuit and the second pixel circuit. The data driver includes a first amplifier circuit and a second amplifier circuit. In use, the display device operates in a sensing driving mode and in a display driving mode. In the sensing driving mode, the first amplifier circuit outputs a sensing data voltage to the first data line during a first set-up period during sensing driving for the first pixel, and outputs the sensing data voltage to the second data line during a second set-up period during sensing driving for the second pixel. Additionally, in the sensing driving mode, the second amplifier circuit outputs a reference voltage to the sensing line during the first set-up period and the second set-up period, outputs a first sensing result of the first pixel during a first sampling period during sensing driving for the first pixel, and outputs a second sensing result of the second pixel during a second sampling period during sensing driving for the second pixel.

In another embodiment, the present disclosure provides a data driver that includes a first amplifier circuit and a second amplifier circuit. The first amplifier circuit is selectively coupleable to a first data line of a first pixel and to second data line of a second pixel. The second amplifier circuit is selectively coupleable to the second data line and to a sensing line. The data driver is operable in a sensing driving mode and in a display driving mode. In the sensing driving mode the first amplifier circuit outputs a sensing data voltage to the first data line during a first set-up period during sensing driving for the first pixel, and outputs the sensing data voltage to the second data line during a second set-up period during sensing driving for the second pixel. Also in the sensing driving mode the second amplifier circuit outputs a reference voltage to the sensing line during the first set-up period and the second set-up period, outputs a first sensing result of the first pixel during a first sampling period during sensing driving for the first pixel, and outputs a second sensing result of the second pixel during a second sampling period during sensing driving for the second pixel.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
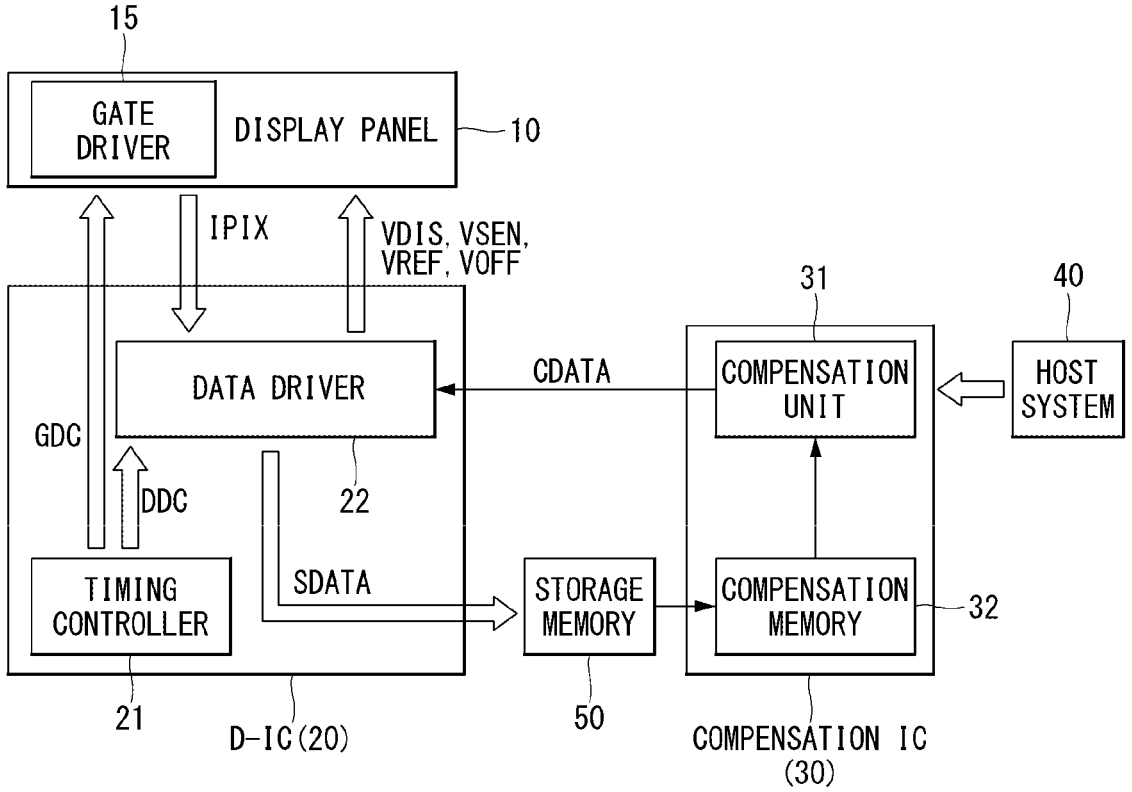
FIG. 1 is a block diagram illustrating an organic light emitting display device according to an embodiment of the present disclosure.

Advantages and features of the present disclosure, and implementation methods thereof will be clarified through the following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

The shapes, sizes, ratios, angles, numbers and the like disclosed in the drawings for describing the embodiments of the present disclosure are illustrative and embodiments of the present disclosure are not limited to those illustrated in the present specification. Like reference numerals refer to like elements throughout the specification. Further, in the description of the present specification, detailed description of known related arts will be omitted if it is determined that the gist of the present specification may be unnecessarily obscured.

In construing an element, the element is construed as including an error range although there is no explicit description.

In describing a position relationship, for example, when two portions are described as "~on", "~above", "~below", or "~on the side", one or more other portions may be positioned between the two portions unless an explicitly limiting term such as "immediately" or "directly" is used.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

In this disclosure, a pixel circuit formed on a substrate of a display panel may be realized as a thin film transistor (TFT) having an n-type metal oxide semiconductor field effect transistor (MOSFET) structure or as a TFT having a p-type MOSFET structure. A TFT is a three-electrode element including a gate, a source, and a drain. The source is an electrode that supplies a carrier to a transistor. In the TFT, carriers start to flow from the source. The drain is an electrode through which the carriers exit from the TFT. That is, in the MOSFET, the carriers flow from the source to the drain. In the case of the n-type TFT, the carriers are electrons, and thus, a source voltage has a voltage lower than a drain voltage so that electrons may flow from the source to the drain. In the n-type TFT, electrons flow from the source to the drain, and thus, current flows from the drain to the source. In contrast, in the case of a p-type TFT (PMOS), since carriers are holes, a source voltage is higher than a drain voltage so that holes may flow from the source to the drain. In the p-type TFT, since holes flow from the source to the drain, current flows from the source to the drain. It should be noted that the source and the drain of the MOSFET are not fixed. For example, the source and the drain of the MOSFET may be changed depending on an applied voltage.

Meanwhile, in the present disclosure, a semiconductor layer of the TFT may be implemented by at least one of an oxide element, an amorphous silicon element, and a polysilicon element.

Hereinafter, embodiments of the present disclosure will be described in detail with reference to the accompanying drawings. In the following embodiments, an organic light emitting display device including an organic luminescent material will mainly be described as a display device.

In describing the present disclosure, if a detailed description for a related known function or construction is considered to unnecessarily divert the gist of the present disclosure, such explanation has been omitted but would be understood by those skilled in the art.

FIG. 1 is a block view illustrating an organic light emitting display device according to an embodiment of the present disclosure.

Referring to FIG. 1, the organic light emitting display device includes a display panel 10, a driver IC (D-IC) 20, a compensation IC 30, a host system 40, and a storage memory 50. A panel driver of the present disclosure includes a gate driver 15 provided in the display panel 10 and a data driver 22 provided in the driver IC (D-IC) 20.

The display panel 10 includes a plurality of pixel lines, and each pixel line includes a plurality of pixels and a plurality of signal lines. The signal lines may include data lines for supplying a display data voltage VDIS and a sensing data voltage VSEN to the pixels, sensing lines supplying a reference voltage VREF to the pixels and sensing a pixel current flowing in the pixels, gate lines supplying a gate signal to the pixels, and a high potential power supply line for supplying a high potential pixel voltage to the pixels.

The pixels of the display panel 10 are arranged in a matrix to constitute a pixel array. Each pixel included in the pixel array may be connected to any one of the data lines, to any one of the sensing lines, to any one of the gate lines, and to the high potential power supply line. Further, each pixel included in the pixel array may be further supplied with a low-potential pixel voltage from a power generation unit, which may be or include any power generation circuitry or electrical components suitable to generate a low-potential pixel voltage.

The display panel 10 may include the gate driver 15. The gate driver 15 may include a plurality of stages for generating gate signals, and output terminals of the stages may be connected to the gate lines. The gate driver may supply a gate signal for controlling switching elements of the pixels to the gate lines.

The driver IC (D-IC) 20 includes a timing controller 21 and the data driver 22.

The timing controller 21 may generate a gate timing control signal GDC for controlling an operation timing of the gate driver 15 and a data timing control signal DDC for controlling an operation timing of the data driver 22 on the basis of timing signals input from the host system 40 such as a vertical synchronization signal Vsync, a horizontal synchronization signal Hsync, a dot clock signal DCLK, and a data enable signal DE. While the host system 40 is shown in FIG. 1 as being communicatively coupled to the compensation IC 30, it will be readily appreciated that the host system 40 may be communicatively coupled, directly or indirectly, to various other circuitry or components of the organic light emitting display device, such as to the timing controller 21.

The data timing control signal DDC may include, but is not limited to, a source start pulse, a source sampling clock, a source output enable signal, and the like. The source start pulse controls a data sampling start timing of the data driver 22. The source sampling clock is a clock signal that controls a sampling timing of data based on a rising or falling edge. The source output enable signal controls an output timing of the data driver 22.

The gate timing control signal GDC may include, but is not limited to, a gate start pulse, a gate shift clock, and the like. The gate start pulse is applied to a stage that generates a first gate output to activate an operation of the stage. The gate shift clock, which is commonly input to the stages, is a clock signal for shifting the gate start pulse.

The timing controller 21 controls an operation timing of the panel driver to sense driving characteristics of the pixels in at least one of a power-on period, a vertical active period of each frame, a vertical blank period of each frame, and a power-off period. Here, the power-on period is a period from a point in time at which system power is applied to a point in time immediately before a screen is turned on, and the power-off period is a period from a point in time at which the screen is turned off to a point in time immediately before system power is disconnected. The vertical active period is a period during which image data is written into the display panel 10 for screen reproduction, and the vertical blank period is a period which is positioned between neighboring vertical active periods and during which writing of image data is stopped. The driving characteristics of the pixels include a threshold voltage and electron mobility of the driving elements (e.g., driving transistors) included in the pixels, and may further include an operating point voltage of light emitting elements included in the pixels.

The timing controller 21 may implement display driving and sensing driving by controlling a sensing driving timing and a display driving timing regarding the pixel lines of the display panel 10 according to a predetermined sequence. The "pixel line" described in the present disclosure refers to an aggregation of pixels adjacent to each other in an extending direction of the gate lines and signal lines connected to the pixels, rather than a physical signal line. For example, a pixel line may refer to a row or a column of pixels of the pixel array.

The timing controller 21 may generate the timing control signals GDC and DDC for display driving and the timing control signals GDC and DDC for sensing driving to be different. Sensing driving refers to sensing driving characteristics of corresponding pixels by writing a sensing data voltage VSEN into sensing target pixels included in each pixel line and updating a compensation value for compensating for a change in driving characteristics of the corresponding pixels on the basis of sensing result data SDATA. Sensing driving includes turning off a pixel current in the corresponding pixels by writing a pixel off power supply voltage VOFF to non-sensing target pixels included in each pixel line. Display driving refers to correcting digital image data to be input to pixels on the basis of the updated compensation value and displaying an input image by applying a display data voltage VDIS corresponding to the corrected image data CDATA to the pixels.

During sensing driving, the pixel current flowing in a driving element of a pixel is not distributed to a light emitting element but is instead output to the sensing line. Therefore, emission of the sensing target pixels stops during sensing driving of the display device. This is to increase accuracy of sensing. If sensing driving is performed during the power-on period or the power-off period, pixel lines are sensed in a state in which the screen is off, and thus, the sensed pixel lines are not visible. In contrast, when sensing driving is performed during the vertical active period or the vertical blank period, pixel lines are sensed in a state in which the screen is on, and thus, the sensed pixel lines are visible. In this case, an emission time of the sensed pixel lines is inevitably shorter than that of the non-sensed pixel lines. Thus, in order to reduce visibility of a line dim due to the time difference in emission, positions of the sensed pixel lines are changed in every frame, and here, the positions of the sensed pixel lines may be changed irrespective of an image scanning order (e.g., randomly or in any order that is different from the image scanning order). The number of sensed pixel lines in each frame may be a single number or a plurality.

The data driver 22 is connected to the data lines and the sensing lines. The data driver 22 generates the sensing data voltage VSEN utilized for sensing driving and the display data voltage VDIS utilized for display driving and supplies the generated data voltages to the data lines. The data driver 22 may generate the reference voltage VREF further utilized for sensing driving and display driving and supply the reference voltage VREF to the sensing lines. The data driver 22 may sense a pixel current input through the sensing lines.

The display data voltage VDIS, which is a digital-to-analog conversion result regarding the digital image data CDATA that is corrected by the compensation IC 30, may vary in magnitude on a pixel-by-pixel basis according to gray level values and compensation values. The sensing data voltage VSEN may be generated to be different for different color pixels, e.g., R (red), G (green), B (blue), and W (white)

pixels, as driving characteristics of driving elements may be different based on the colors of the pixels.

The data driver 22 drives three signal lines, e.g., two data lines connected to two pixels and one sensing line connected in common to the two pixels, with two amplifiers. In the related art, three amplifiers were required to drive three signal lines, but in various embodiments provided by the present disclosure, three signal lines are driven using two amplifiers through amplifier sharing. According to the present disclosure, a chip size and power consumption of the driver IC (D-IC) 20 are therefore reduced.

The data driver 22 supplies a power supply voltage VOFF for pixel off (or pixel off power supply voltage), which is further utilized for sensing driving, to the data lines. The pixel off power supply voltage VOFF is a data voltage for turning off a pixel current in the non-sensing target pixels during sensing driving. In the related art, the pixel off power supply voltage VOFF is generated through an amplifier, consuming a relatively large amount of power due to the amplifier operation. In some embodiments of the present disclosure, the data driver 22 includes a base power supply circuit (which may be referred to herein as a base power supply unit) for supplying the pixel off power supply voltage VOFF, thereby minimizing or reducing the amplifier operation which otherwise would result in large power consumption.

The storage memory 50 stores the digital sensing result data SDATA input from the data driver 22 during sensing driving. The storage memory 50 may be realized as a flash memory but embodiments of the present disclosure are not limited thereto.

The compensation IC 30 may include compensation circuitry 31 (which may be referred to as a compensation unit 31) and a compensation memory 32. The compensation memory 32 delivers the digital sensing result data SDATA read from the storage memory 50 to the compensation unit 31. The compensation memory 32 may be any computer-readable storage medium, and in some embodiments may be a random access memory (RAM), e.g., a double data rate synchronous dynamic RAM (DDR SDRAM) but embodiments of the present disclosure are not limited thereto. The compensation unit 31 calculates a compensation offset and compensation gain for each pixel on the basis of the digital sensing result data SDATA read from the storage memory 50, corrects image data input from the host system 40 on the basis of the calculated compensation offset and compensation gain, and supplies the corrected image data CDATA to the data driver 22. The compensation unit 31 may include any electrical circuitry, components, or the like configured to perform the various features and functionalities described herein with respect to the compensation unit 31.

Figure 2:
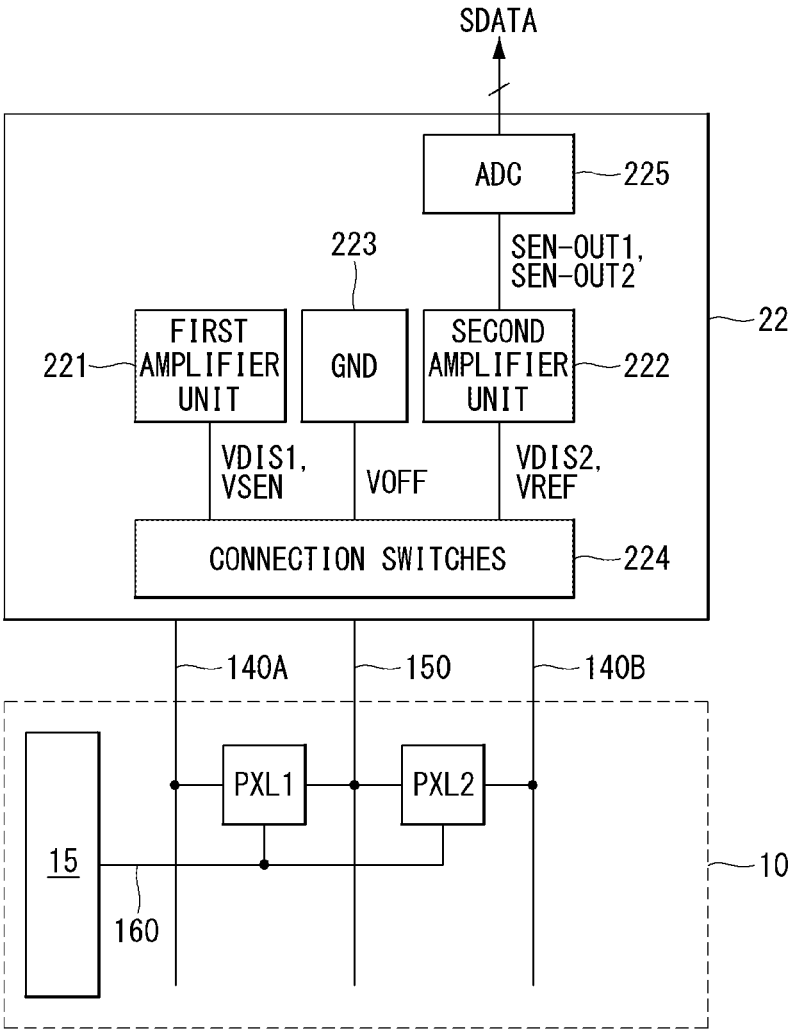
FIG. 2 is a block diagram illustrating a connection state between a data driver and a display panel according to an embodiment of the present disclosure.

FIG. 2 is a block diagram illustrating a connection state between the data driver and the display panel according to an embodiment of the present disclosure.

Referring to FIG. 2, the display panel 10 may include a first data line 140A connected to a first pixel PXL1, a second data line 140B connected to a second pixel PXL2, and a sensing line 150 connected in common to the first and second pixels PXL1 and PXL2. The first and second pixels PXL1 and PXL2 are simultaneously driven for display and sequentially driven for sensing at different times.

The data driver 22 includes a first amplifier circuit 221 (which may be referred to herein as a first amplifier unit), a second amplifier circuit 222 (which may be referred to herein as a second amplifier unit), a base power supply unit (GND) 223, connection switches 224, and an analog-to-digital converter (ADC) 225 to drive the three signal lines 140A, 140B, and 150 connected to the first and second pixels PXL1 and PXL2.

During sensing driving, the first amplifier unit 221 is selectively connected to the first data line 140A and the second data line 140B to supply the sensing data voltage VSEN to the corresponding data lines, and during display driving, the first amplifier unit 221 supplies a first display data voltage VDIS1 to the first data line 140A. The first amplifier unit 221 includes one amplifier.

The second amplifier unit 222 supplies, during sensing driving, the reference voltage VREF to the sensing line 150 and subsequently receives a first pixel current of the first pixel PXL1 or a second pixel current of the second pixel PXL2 from the sensing line 150, and supplies, during display driving, the reference voltage VREF to the sensing line 150 and subsequently supplies a second display data voltage VDIS2 to the second data line 140B. Also, during sensing driving, the second amplifier unit 222 outputs a sensing result SEN-OUT1 of the first pixel current and a sensing result SEN-OUT2 of the second pixel current to the ADC 225. The second amplifier unit 222 includes one amplifier.

During sensing driving, the base power supply unit GND 223 is selectively connected to the first data line 140A and the second data line 140B and supplies the pixel off power supply voltage VOFF to the corresponding data lines. The pixel off power supply voltage VOFF may be a ground voltage, but is not limited thereto.

The connection switches 224 are switched so that the two amplifiers (e.g., one amplifier in each of the first and second amplifier units 221, 222) may drive the three signal lines 140A, 140B, and 150. According to the switching operation of the connection switches 224, the first and second pixels PXL1 and PXL2 may be simultaneously driven for display and sequentially driven for sensing at different times.

During sensing driving, the ADC 225 converts the sensing result SEN-OUT1 of the first pixel current and the sensing result SEN-OUT2 of the second pixel current input from the second amplifier unit 222 into the digital sensing result data SDATA, and subsequently supplies the converted digital sensing result data SDATA to the storage memory 50.

Figure 3:
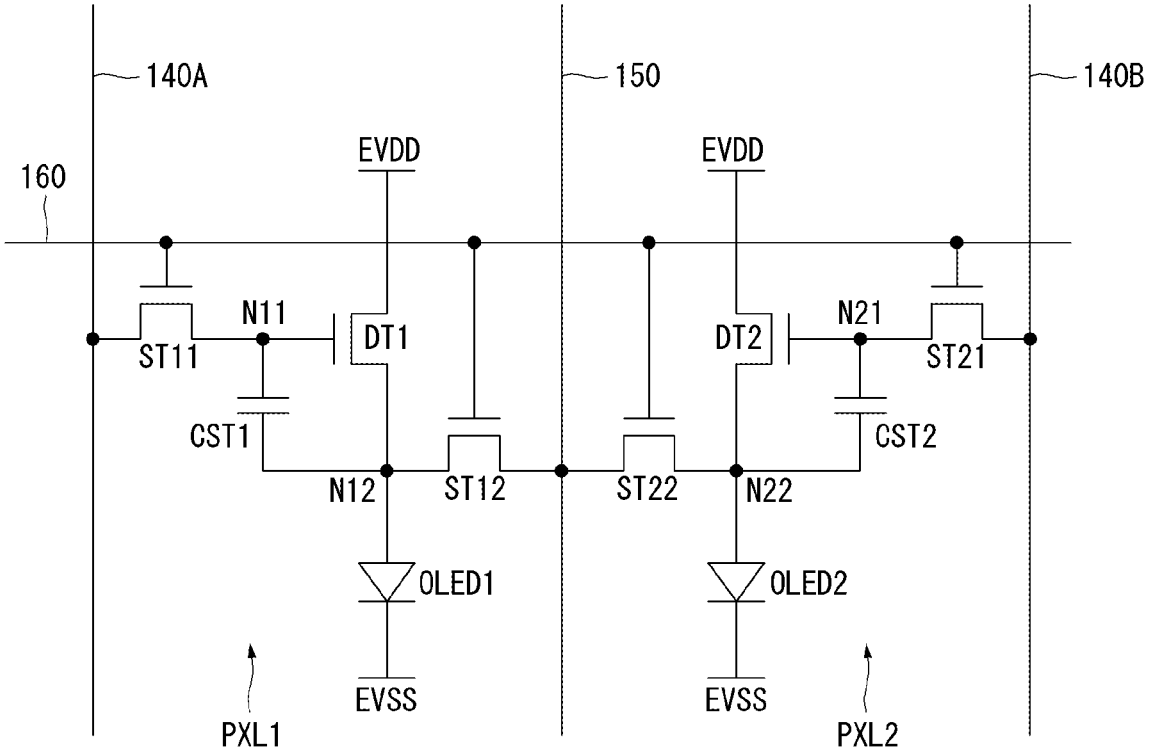
FIG. 3 is an equivalent circuit diagram of a first pixel and a second pixel according to an embodiment of the present disclosure.

FIG. 3 is an equivalent circuit diagram of the first pixel and the second pixel according to an embodiment of the present disclosure.

Referring to FIG. 3, the first pixel PXL 1 and the second pixel PXL 2 are connected to the different data lines 140A and 140B and are connected in common to the same sensing line 150. Here, the specific circuits of the first pixel PXL1 and the second pixel PXL2 are merely examples and may be variously modified in various embodiments of the present disclosure. That is, embodiments of the present disclosure are not limited to the pixel configuration illustrated in FIG. 3.

The first pixel PXL1 includes an organic light emitting device (OLED) OLED1, a driving TFT DT1, first and second switching TFTs ST11 and ST12, and a storage capacitor CST1.

The OLED1 is a light emitting element that emits light with intensity corresponding to a pixel current drawn from the driving TFT DT1 during display driving. An anode electrode of the OLED1 is connected to a second node N12, and a cathode electrode is connected to the input terminal of the low potential pixel voltage EVSS. During display driving, the OLED1 is turned on to start to emit light when a voltage at the second node N12 increases to an operating point voltage. However, during sensing driving, the OLED1 does not emit light. This is because sensing driving is performed in a state in which the voltage at the second node N12 is lower than the operating point voltage of the OLED1.

The driving TFT DT1 is a driving element for generating a pixel current corresponding to a gate-source voltage. A gate electrode of the driving TFT DT1 is connected to a first node N11, a drain electrode thereof is connected to the input terminal of the high potential pixel voltage EVDD, and a source electrode thereof is connected to the second node N12.

The first and second switching TFTs ST11 and ST12 set the gate-source voltage of the driving TFT DT1. During display driving, the gate-source voltage of the driving TFT DT1 corresponds to a difference between the first display data voltage VDIS1 and the reference voltage VREF. During sensing driving, the gate-source voltage of the driving TFT DT corresponds to a difference between the sensing data voltage VSEN and the reference voltage VREF. The second switching TFT ST12 serves to connect the driving TFT DT1 and the data driver 22, for example, through the sensing line 150.

A gate electrode of the first switching TFT ST11 is connected to the gate line 160, a drain electrode thereof is connected to the first data line 140A, and a source electrode thereof is connected to the first node N11. During display driving, the first switching TFT ST11 is turned on in response to a gate signal from the gate line 160 and supplies the first display data voltage VDIS1 charged in the first data line 140A to the first node N11. During sensing driving, the first switching TFT ST11 is turned on in response to the gate signal from the gate line 160 and applies the sensing data voltage VSEN charged in the first data line 140A to the first node N11.

A gate electrode of the second switching TFT ST12 is connected to the gate line 160, a drain electrode thereof is connected to the second node N12, and a source electrode thereof is connected to the sensing line 150. During display driving, the second switching TFT ST12 is turned on in response to a gate signal from the gate line 160 and applies the reference voltage VREF charged in the sensing line 150 to the second node N12. Also, during sensing driving, the second switching TFT ST12 is turned on in response to the gate signal from the gate line 160 and applies the reference voltage VREF charged in the sensing line 150 to the second node N12, and thereafter, the second switch TFT ST 12 applies the first pixel current flowing in the driving TFT DT1 to the data driver 22 through the sensing line 150.

The storage capacitor CST1 is connected between the first node N11 and the second node N12 to maintain the gate-source voltage of the driving TFT DT1 for a desired period.

The second pixel PXL2 includes an OLED2, a driving TFT DT2, first and second switching TFTs ST21 and ST22, and a storage capacitor CST2.

The OLED2 is a light emitting element that emits light with intensity corresponding to a pixel current drawn from the driving TFT DT2 during display driving. An anode electrode of the OLED2 is connected to a second node N22, and a cathode electrode is connected to the input terminal of the low potential pixel voltage EVSS. During display driving, the OLED2 is turned on to start to emit light when a voltage at the second node N22 increases to an operating point voltage. However, during sensing driving, the OLED2 does not emit light. This is because sensing driving is performed in a state in which the voltage at the second node N22 is lower than the operating point voltage of the OLED2.

The driving TFT DT2 is a driving element for generating a pixel current corresponding to a gate-source voltage. A gate electrode of the driving TFT DT2 is connected to a first node N21, a drain electrode thereof is connected to the input terminal of the high potential pixel voltage EVDD, and a source electrode thereof is connected to the second node N22.

The first and second switching TFTs ST21 and ST22 set the gate-source voltage of the driving TFT DT2. During display driving, the gate-source voltage of the driving TFT DT2 corresponds to a difference between the second display data voltage VDIS2 and the reference voltage VREF. During sensing driving, the gate-source voltage of the driving TFT DT2 corresponds to a difference between the sensing data voltage VSEN and the reference voltage VREF. The second switching TFT ST22 serves to connect the driving TFT DT2 and the data driver 22 through the sensing line 150.

A gate electrode of the first switching TFT ST21 is connected to the gate line 160, a drain electrode thereof is connected to the second data line 140B, and a source electrode thereof is connected to the first node N21. During display driving, the first switching TFT ST21 is turned on in response to a gate signal from the gate line 160 and supplies the second display data voltage VDIS2 charged in the second data line 140B to the first node N21. During sensing driving, the first switching TFT ST21 is turned on in response to the gate signal from the gate line 160 and applies the sensing data voltage VSEN charged in the second data line 140B to the first node N21.

A gate electrode of the second switching TFT ST22 is connected to the gate line 160, a drain electrode thereof is connected to the second node N22, and a source electrode thereof is connected to the sensing line 150. During display driving, the second switching TFT ST22 is turned on in response to a gate signal from the gate line 160 and applies the reference voltage VREF charged in the sensing line 150 to the second node N22. Also, during sensing driving, the second switching TFT ST12 is turned on in response to the gate signal from the gate line 160 and applies the reference voltage VREF charged in the sensing line 150 to the second node N22, and thereafter, the second switching TFT ST 22 applies the second pixel current flowing in the driving TFT DT2 to the data driver 22 through the sensing line 150.

The storage capacitor CST2 is connected between the first node N21 and the second node N22 to maintain the gate-source voltage of the driving TFT DT2 for a desired period.

Figure 4:
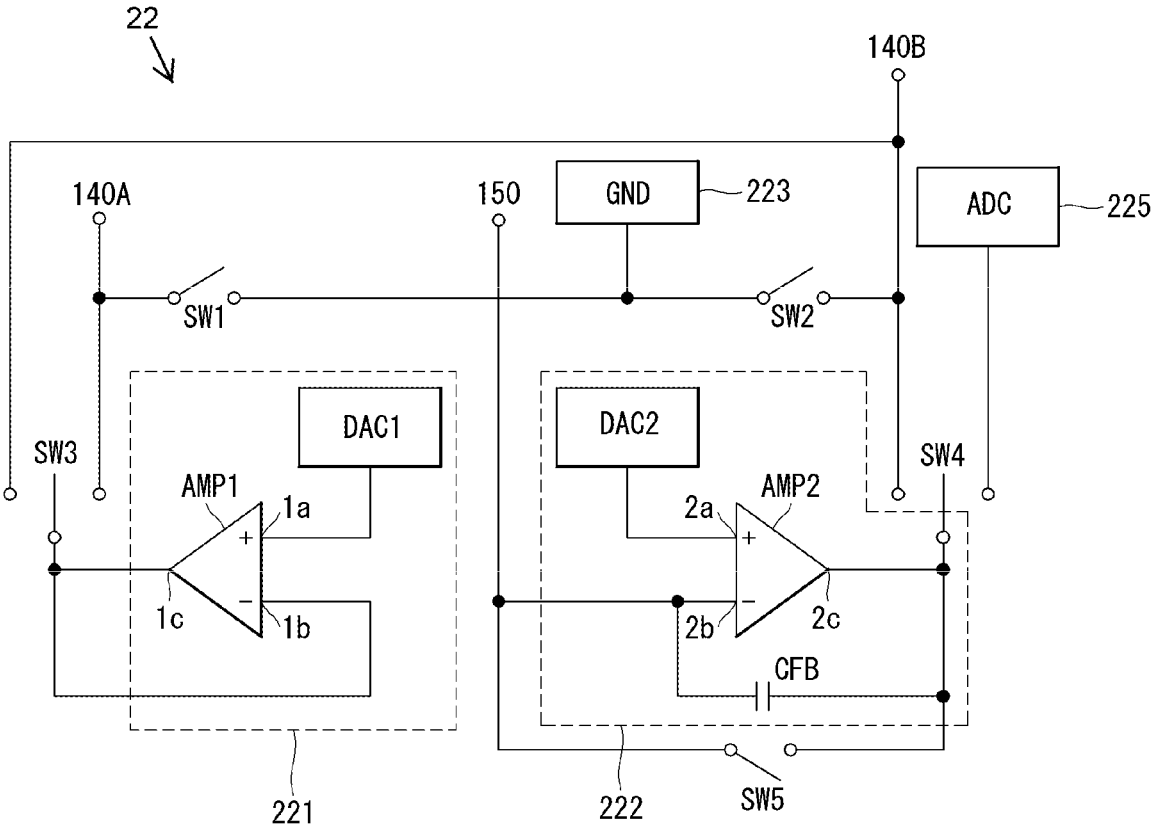
FIG. 4 is a schematic circuit diagram of a data driver according to an embodiment of the present disclosure.

FIG. 4 is a schematic circuit diagram of the data driver according to an embodiment of the present disclosure.

Referring to FIG. 4, the first amplifier unit 221 includes a digital-to-analog converter (DAC) DAC1 generating the sensing data voltage VSEN and the first display data voltage VDIS1 and a first amplifier AMP1 outputting the sensing data voltage VSEN and the first display data voltage VDIS1.

The first amplifier AMP1 includes a non-inverting (+) input terminal 1*a*, an inverting (−) input terminal 1*b*, and an output terminal 1*c*. The non-inverting (+) input terminal 1*a* is connected to an output terminal of the DAC1. The inverting (−) input terminal 1*b* and the output terminal 1*c* are connected to one another, e.g., short-circuited. Accordingly, the first amplifier AMP1 operates as an output buffer stably outputting an output of the DAC1.

Referring to FIG. 4, the second amplifier unit 222 includes a digital-to-analog converter (DAC) DAC2 for generating the reference voltage VREF and the second display data voltage VDIS2, a second amplifier AMP2 outputting the reference voltage VREF and the second display data voltage VDIS2 and receiving a first pixel current or a second pixel current, and a feedback capacitor CFB connected between an output terminal 2*c* of the second amplifier MP2 and the sensing line 150.

The second amplifier AMP2 includes a non-inverting (+) input terminal 2*a*, an inverting (−) input terminal 2*b*, and an output terminal 2*c*. The non-inverting (+) input terminal 2*a* is connected to an output terminal of the DAC2. A feedback capacitor CFB and a fifth connection switch SW5 are connected in parallel between the inverting (−) input terminal 2*b* and the output terminal 1*c*. Accordingly, when the fifth connection switch SW5 is turned on, the second amplifier AMP2 operates as an output buffer that stabilizes the output of the DAC2, and when the fifth connection switch SW5 is turned off, the second amplifier AMP2 operates as a current integrator integrating the first pixel current or the second pixel current.

Referring to FIG. 4, the connection switches include first to fifth connection switches SW1 to SW5. The first to fifth connection switches SW1 to SW5 may be any switches or switching elements suitable to selectively electrically couple one circuit element, wiring, or the like to another. In some embodiments, each of the connection switches SW1 to SW5 may include one or more transistors.

The first connection switch SW1 turns on/off connection between the base power supply unit (GND) 223 and the first data line 140A. The second connection switch SW2 turns on/off connection between the base power supply unit (GND) 223 and the second data line 140B. The third connection switch SW3 selectively connects the output terminal 1*c* of the first amplifier AMP1 to the first data line 140A and the second data line 140B. The fourth connection switch SW4 selectively connects the output terminal 2*c* of the second amplifier AMP2 to the second data line 140B and the ADC 225. The fifth connection switch SW5 turns on/off connection between the output terminal 2*c* of the second amplifier AMP2 and the sensing line 150.

Figure 5A:
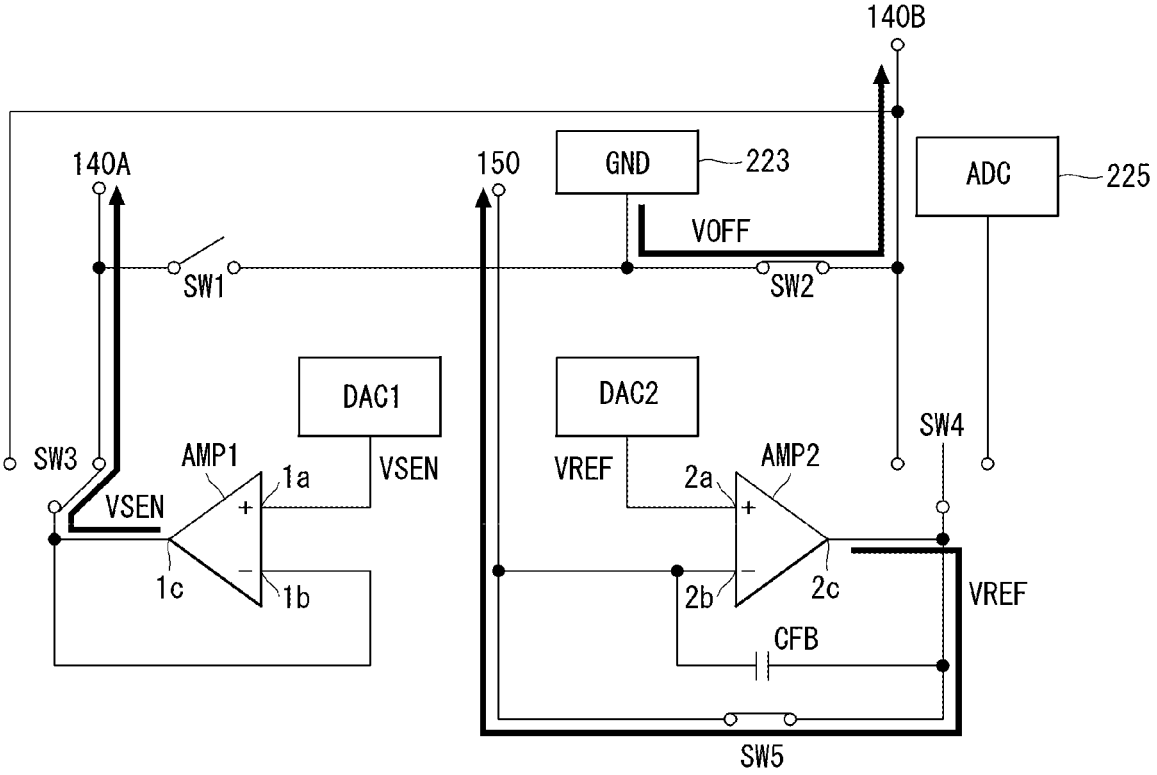
FIGS. 5A and 5B are views illustrating operations of a data driver and pixels during a first set-up period during sensing driving for a first pixel.
Figure 5B:
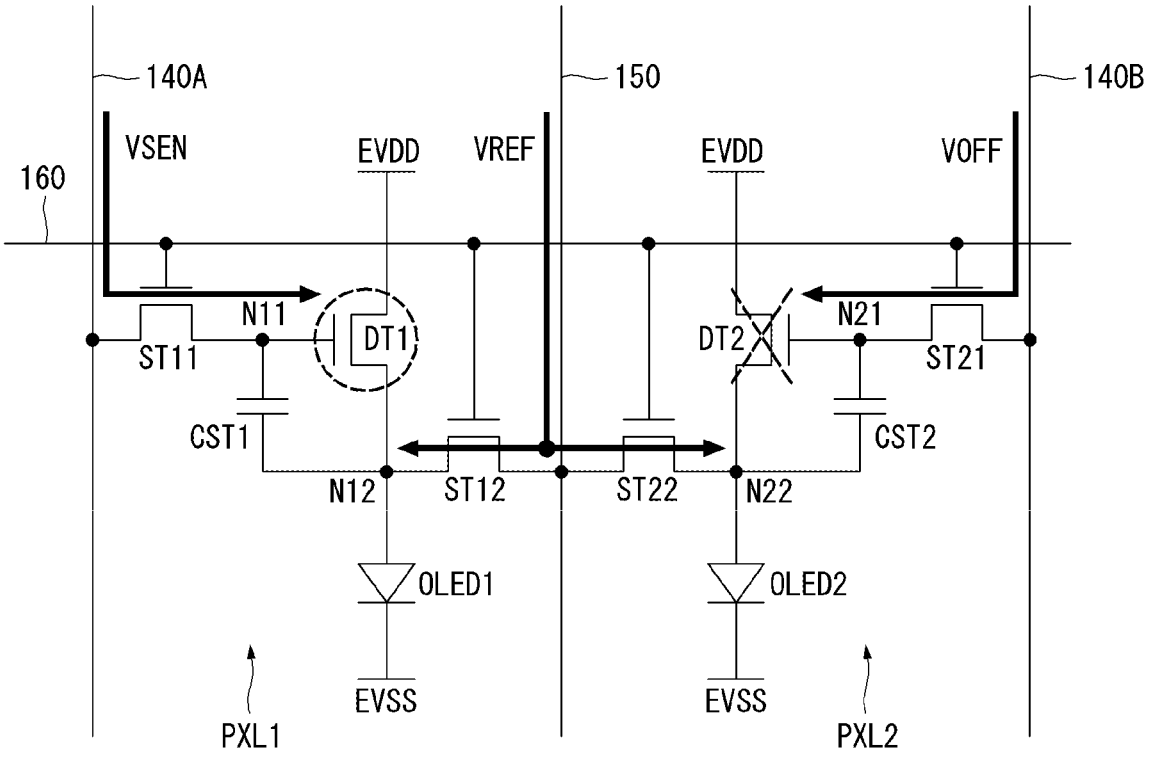
Figure 6A:
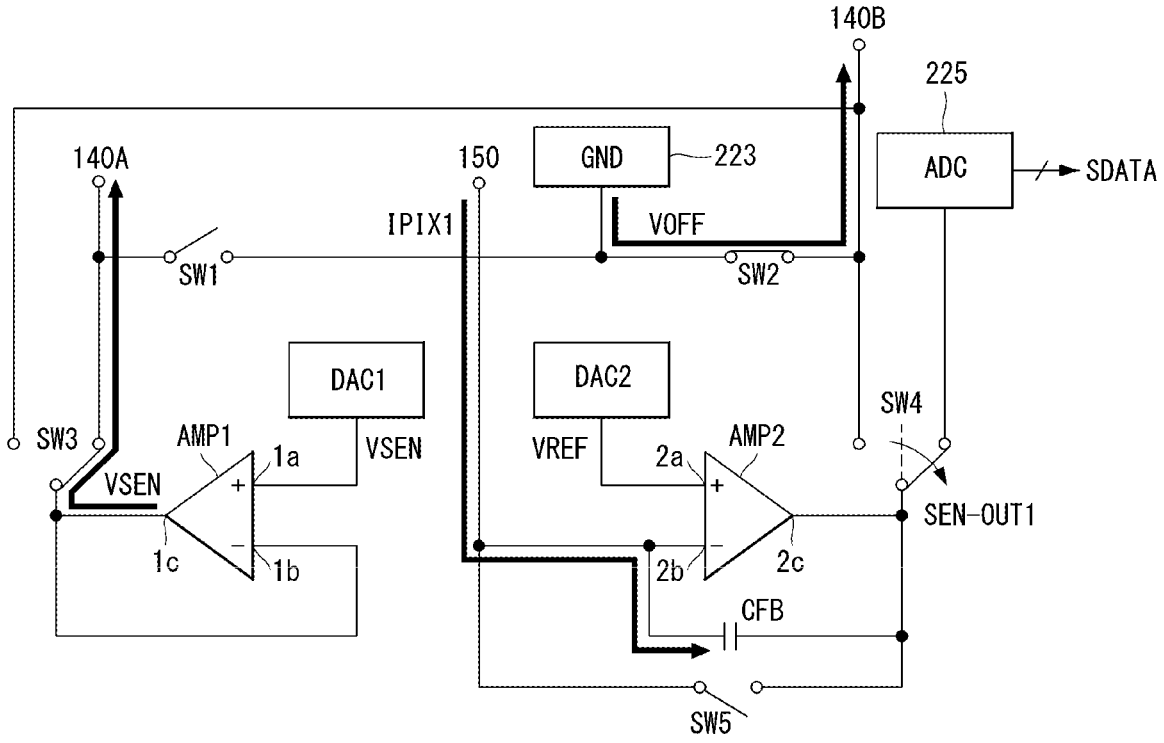
FIGS. 6A and 6B are views illustrating operations of a data driver and a pixel during a first sensing period and a first sampling period during sensing driving for a first pixel.
Figure 6B:
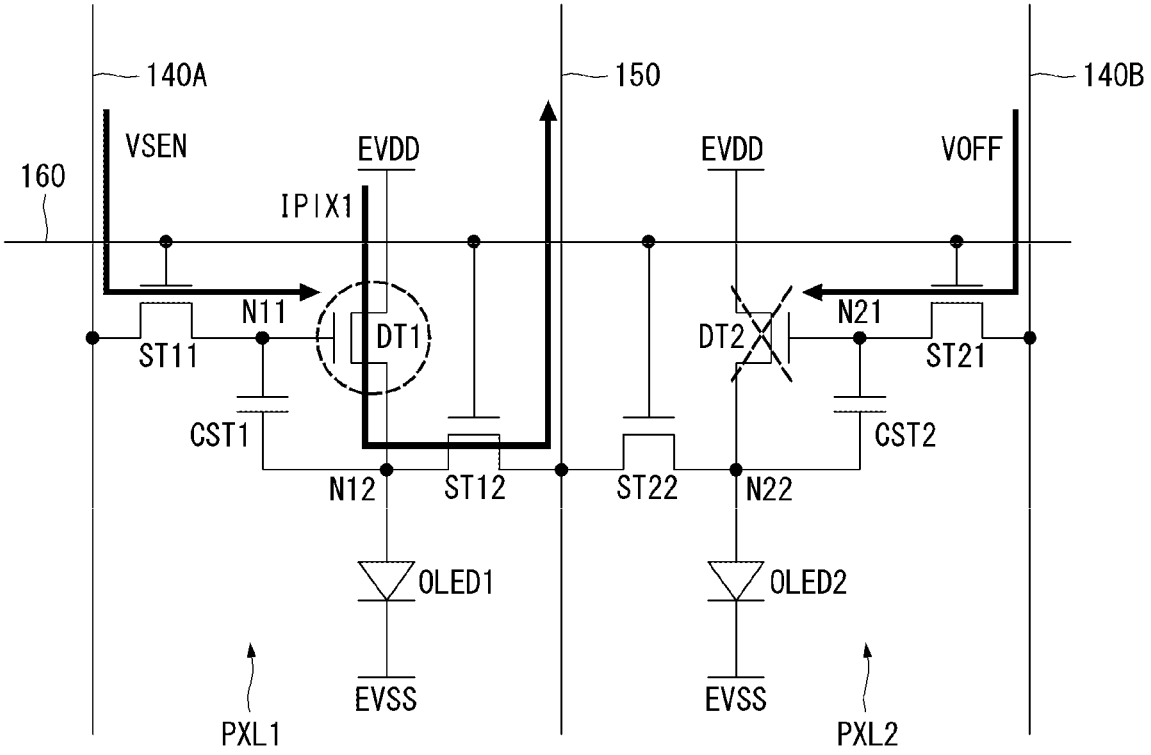

FIGS. 5A and 5B are views illustrating operations of the data driver and pixels during a first set-up period during sensing driving for the first pixel. FIGS. 6A and 6B illustrate operations of the data driver and a pixel during a first sensing period and a first sampling period during sensing driving for the first pixel.

Sensing driving for the first pixel PXL1 and sensing driving for the second pixel PXL2 are performed at different times (i.e., in a time division manner). Sensing driving for the first pixel PXL1 is performed in order of a first set-up period, a first sensing period, and a first sampling period.

Referring to FIG. 5A, during the first set-up period, the first connection switch SW1 is turned off, the second connection switch SW2 is turned on, the third connection switch SW3 is connected to the first data line 140A, the fourth connection switch SW4 is floated (i.e., it is not connected either of the second data line 140B or the ADC 225), and the fifth connection switch SW5 is turned on. Accordingly, during the first set-up period, the first amplifier AMP1 is configured as an output buffer outputting the sensing data voltage VSEN generated in the DAC1 to the first data line 140A, and the second amplifier AMP2 is configured as an output buffer outputting the reference voltage generated in the DAC2 to the sensing line 150. Also, during the first set-up period, the base power supply unit (GND) 223 supplies the pixel off power supply voltage VOFF to the second data line 140B.

Referring to FIG. 5B, the sensing data voltage VSEN output from the first amplifier AMP1 during the first set-up period is applied to the first node N11 of the first pixel PXL1 through the first data line 140A and through the first switching TFT ST11 of the first pixel PXL1. The pixel off power supply voltage VOFF output from the base power supply unit (GND) 223 during the first set-up period is applied to the first node N21 of the second pixel PXL2 through the second data line 140B and through the first switching TFT ST21 of the second pixel PXL2. The reference voltage VREF output from the second amplifier AMP2 during the first set-up period is applied to the second nodes N12 and N22 of the first and second pixels PXL1 and PXL2 through the sensing line 150 and through the second switching TFTs ST12, ST22 of the first and second pixels PXL1 and PXL2. Accordingly, during the first set-up period, the gate-source voltage VSEN-VREF of the driving TFT DT1 included in the first pixel PXL1 is set to a magnitude that turns on the driving TFT DT1 (i.e., a magnitude that allows the first pixel current to flow) and the gate-source voltage VOFF-VREF of the driving TFT DT2 included in the second pixel PXL2 is set to a magnitude that turns off the driving TFT DT2 (i.e., a magnitude that interrupts the second pixel current).

Referring to FIG. 6B, during the first sensing period and the first sampling period, the first pixel current IPIX1 flows through the driving TFT DT1 of the first pixel PXL1 and the driving TFT DT2 of the second pixel PXL2 maintains an off state.

Referring to FIG. 6A, during the first sensing period, the first connection switch SW1 is turned off, the second connection switch SW2 is turned on, the third connection switch SW3 is connected to the first data line 140A, the fourth connection switch SW4 is floated, and the fifth connection switch SW5 is turned off. Accordingly, during the first sensing period, the first amplifier AMP1 is configured as an output buffer outputting the sensing data voltage VSEN generated in the DAC1 to the first data line 140A, and the second amplifier AMP2 is configured as a current integrator integrating the first pixel current IPIX1 input from the sensing line 150. An output voltage applied to the output terminal 2*c* of the second amplifier AMP2 is changed as the first pixel current IPIX1 accumulates in the feedback capacitor CFB and the output voltage is the sensing result SEN-OUT1 of the first pixel current IPIX1.

Referring to FIG. 6A, during the first sampling period (which may be a period immediately after the first sensing period), the fourth connection switch SW4 is selectively actuated so that it is changed from the floating state to a state in which it is connected to the ADC 225. Then, the ADC 225 converts the sensing result SEN-OUT1 of the first pixel current IPIX1 into the digital sensing data SDATA. Meanwhile, during the first sampling period, on/off states of the other switches SW1 to SW3 and SW5 are the same as those of the first sensing period.

Figure 7A:
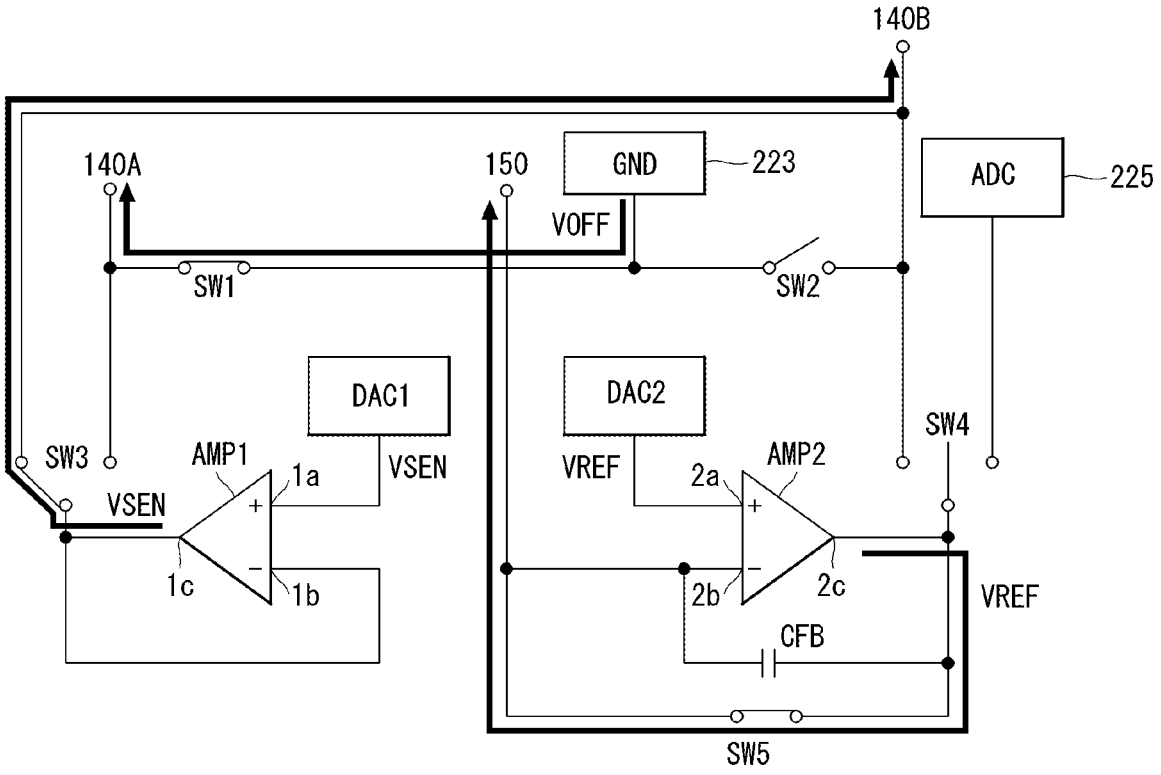
FIGS. 7A and 7B are views illustrating operations of a data driver and a pixel during a second set-up period during sensing driving for a second pixel.
Figure 7B:
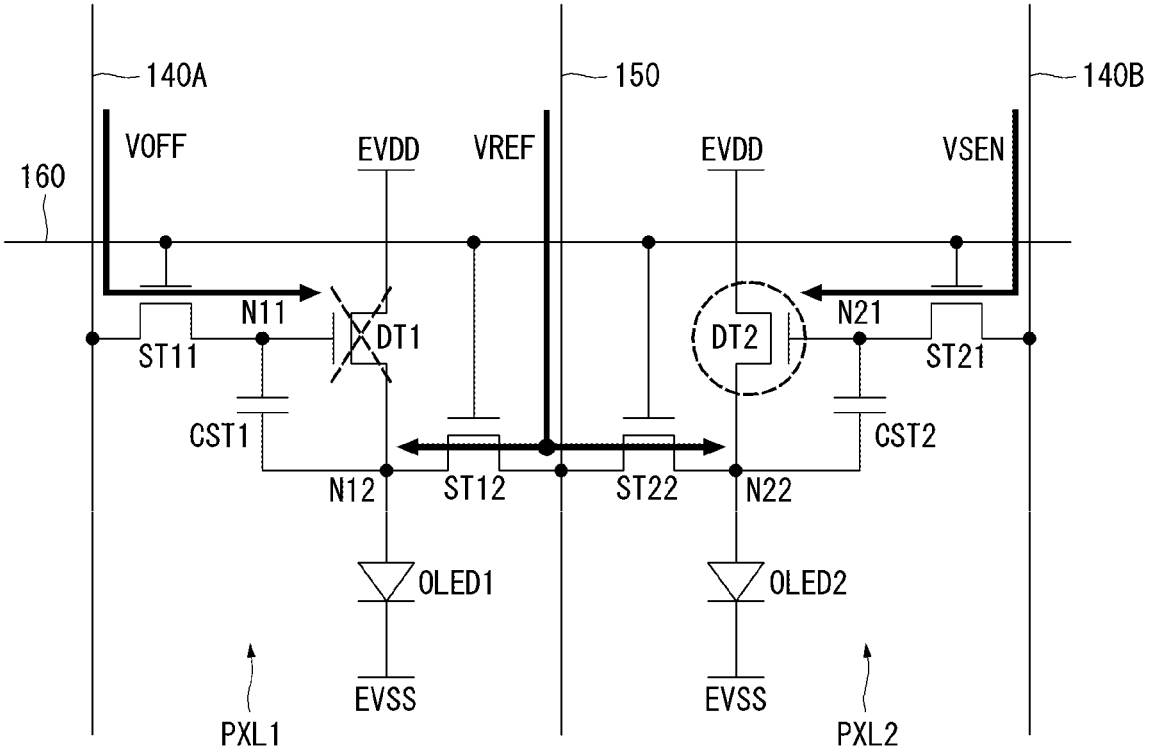
Figure 8A:
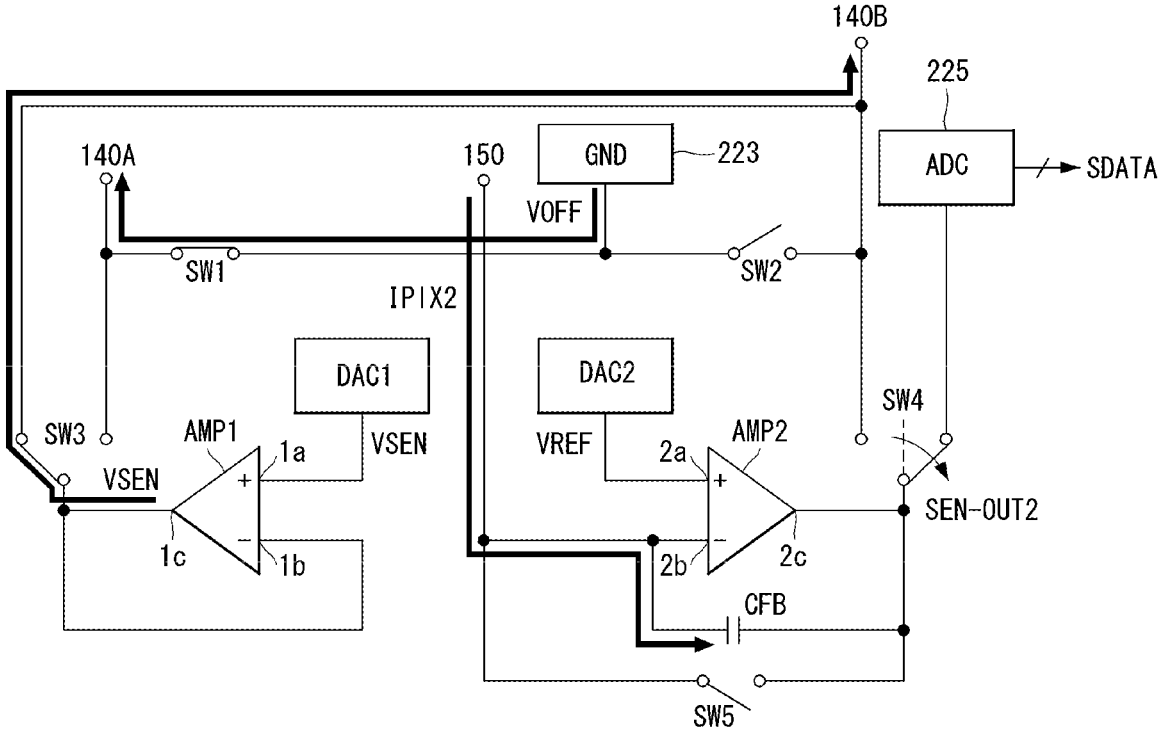
FIGS. 8A and 8B are views illustrating operations of a data driver and a pixel during a second sensing period and a second sampling period during sensing driving for a second pixel.
Figure 8B:
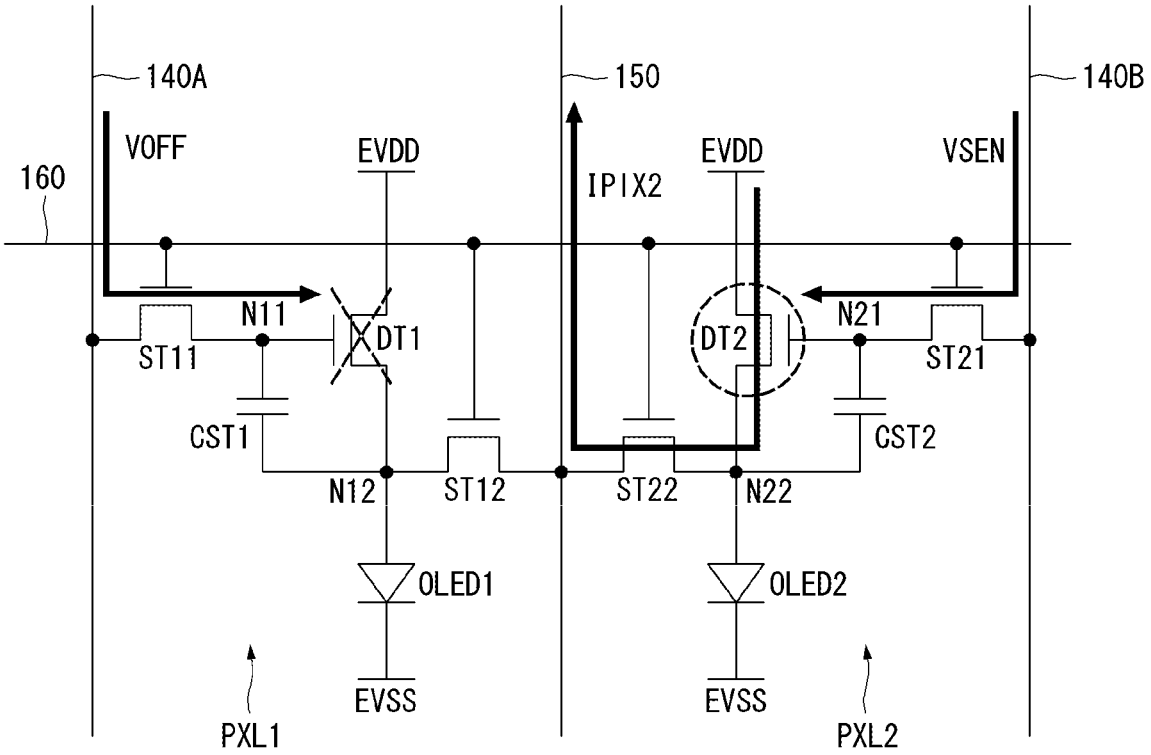

FIGS. 7A and 7B are views illustrating operations of the data driver and a pixel during a second set-up period during sensing driving for the second pixel. FIGS. 8A and 8B are views illustrating operations of the data driver and a pixel during a second sensing period and a second sampling period during sensing driving for the second pixel.

Sensing driving for the second pixel PXL2 and sensing driving for the first pixel PXL1 are performed at different times (i.e., in a time division manner). In some embodiments, sensing driving for the first and second pixels PXL1, PXL2 may be performed sequentially, for example, with sensing driving being performed for the first pixel PXL1 and then for the second pixel PXL2. Sensing driving for the second pixel PXL2 is performed in order of a second set-up period, a second sensing period, and a second sampling period.

Referring to FIG. 7A, during the second set-up period, the first connection switch SW1 is turned on, the second connection switch SW2 is turned off, the third connection switch SW3 is connected to the second data line 140B, the fourth connection switch SW4 is floated, and the fifth connection switch SW5 is turned on. Accordingly, during the second set-up period, the first amplifier AMP1 is configured as an output buffer outputting the sensing data voltage VSEN generated in the DAC1 to the second data line 140B, and the second amplifier AMP2 is configured as an output buffer outputting the reference voltage generated in the DAC2 to the sensing line 150. Also, during the second set-up period, the base power supply unit (GND) 223 supplies the pixel off power supply voltage VOFF to the first data line 140A.

Referring to FIG. 7B, the sensing data voltage VSEN output from the first amplifier AMP1 during the second set-up period is applied to the first node N21 of the second pixel PXL2 through the second data line 140B and through the first switching TFT ST21 of the second pixel PXL2. The pixel off power supply voltage VOFF output from the base power supply unit (GND) 223 during the second set-up period is applied to the first node N11 of the first pixel PXL1 through the first data line 140A and through the first switching TFT ST11 of the first pixel PXL1. The reference voltage VREF output from the second amplifier AMP2 during the second set-up period is applied to the second nodes N12 and N22 of the first and second pixels PXL1 and PXL2 through the sensing line 150 and through the second switching TFTs ST12, ST22 of the first and second pixels PXL1 and PXL2. Accordingly, during the second set-up period, the gate-source voltage VOFF-VREF of the driving TFT DT1 included in the first pixel PXL1 is set to a magnitude that turns off the driving TFT DT1 (i.e., a magnitude that interrupts the first pixel current) and the gate-source voltage VSEN-VREF of the driving TFT DT2 included in the second pixel PXL2 is set to a magnitude that turns on the driving TFT DT2 (that is, a magnitude that turns on the second pixel current).

Referring to FIG. 8B, during the second sensing period and the second sampling period, the second pixel current IPIX2 flows through the driving TFT DT2 of the second pixel PXL2 and the driving TFT DT1 of the first pixel PXL1 maintains an off state.

Referring to FIG. 8A, during the second sensing period, the first connection switch SW1 is turned on, the second connection switch SW2 is turned off, the third connection switch SW3 is connected to the second data line 140B, the fourth connection switch SW4 is floated, and the fifth connection switch SW5 is turned off. Accordingly, during the second sensing period, the first amplifier AMP1 is configured as an output buffer outputting the sensing data voltage VSEN generated in the DAC1 to the second data line 140B, and the second amplifier AMP2 is configured as a current integrator integrating the second pixel current IPIX2 input from the sensing line 150. An output voltage applied to the output terminal 2*c* of the second amplifier AMP2 is changed as the second pixel current IPIX2 accumulates in the feedback capacitor CFB and the output voltage is the sensing result SEN-OUT2 of the second pixel current IPIX2.

Referring to FIG. 8A, during the second sampling period (which may be a period immediately after the second sensing period), the fourth connection switch SW4 is selectively actuated so that it is changed from the floating state to a state in which it is connected to the ADC 225. The ADC 225 then converts the sensing result SEN-OUT2 of the second pixel current IPIX2 into the digital sensing data SDATA. Meanwhile, during the second sampling period, on/off states of the other switches SW1 to SW3 and SW5 are the same as those of the second sensing period.

Figure 9A:
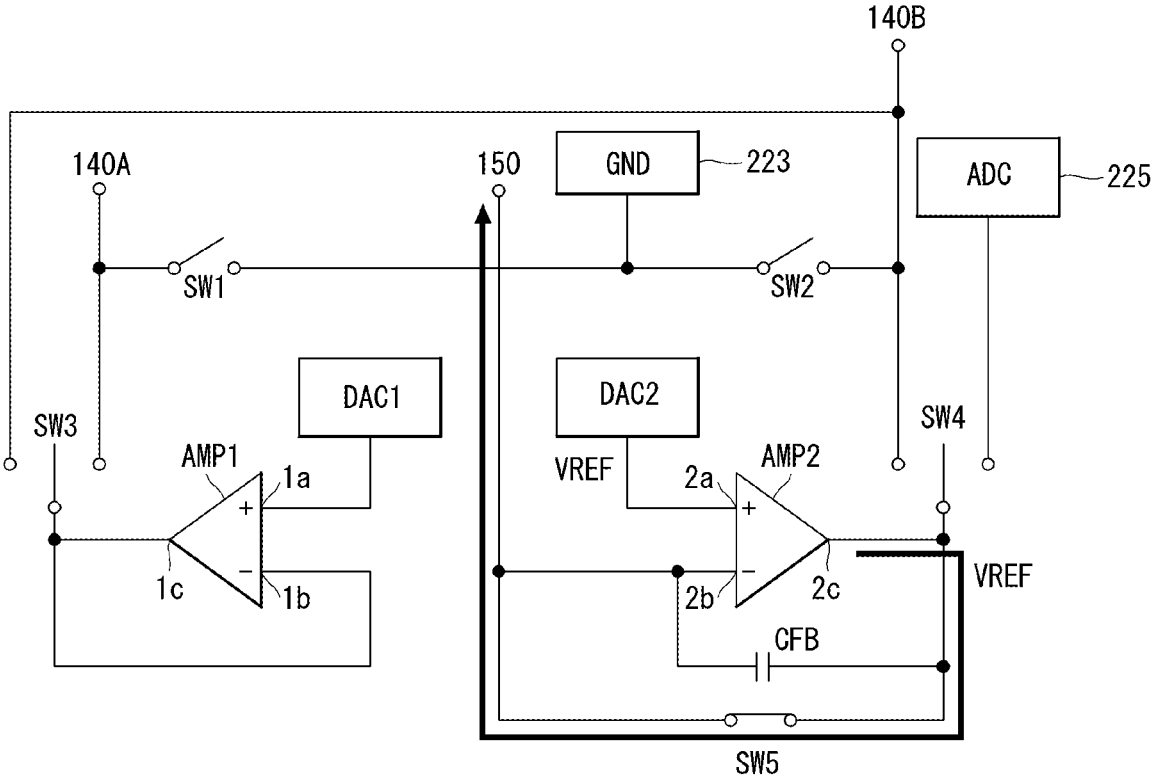
FIGS. 9A and 9B are views illustrating operations of a data driver and pixels during a first programming period during display driving for a first pixel and a second pixel.
Figure 9B:
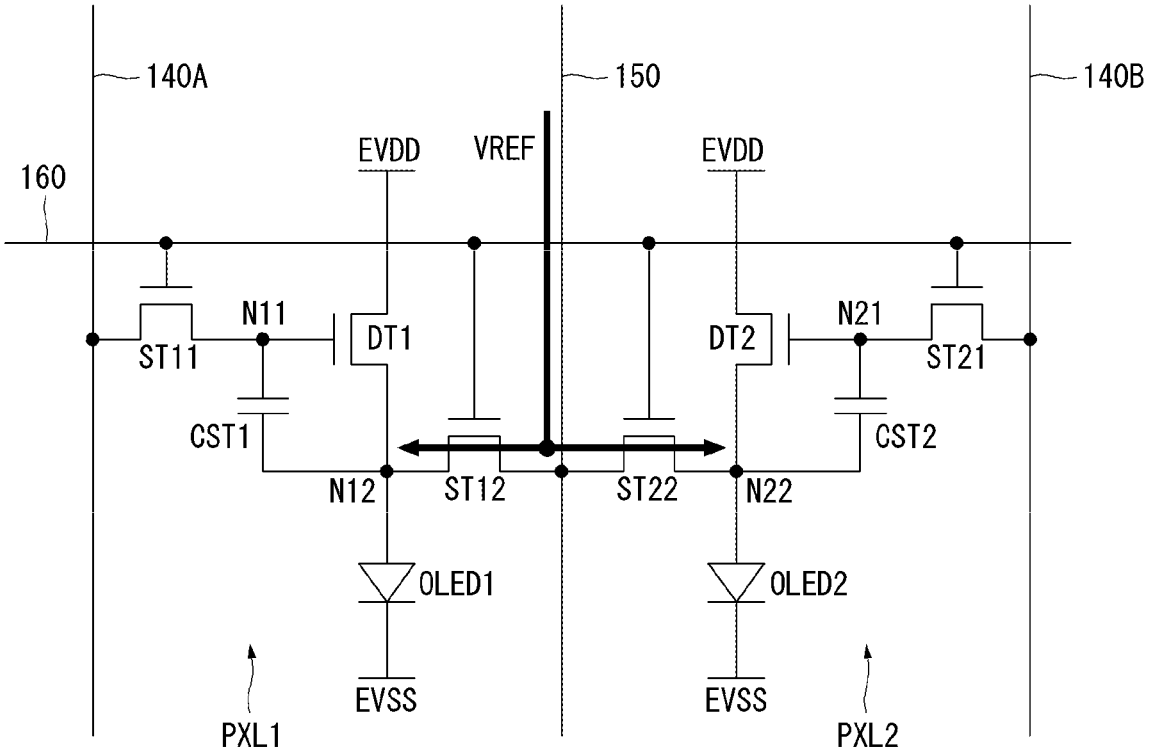
Figure 10A:
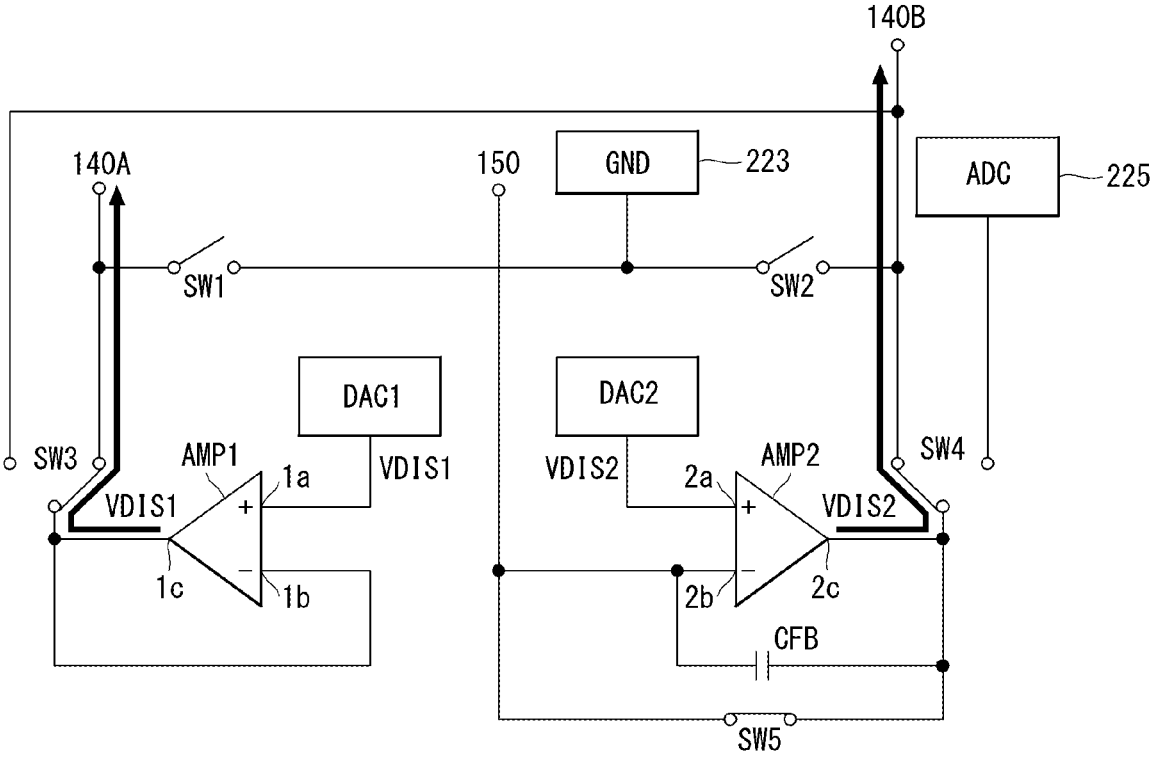
FIGS. 10A and 10B are views illustrating operations of a data driver and pixels during a second programming period and an emission period during display driving for a first pixel and a second pixel.
Figure 10B:
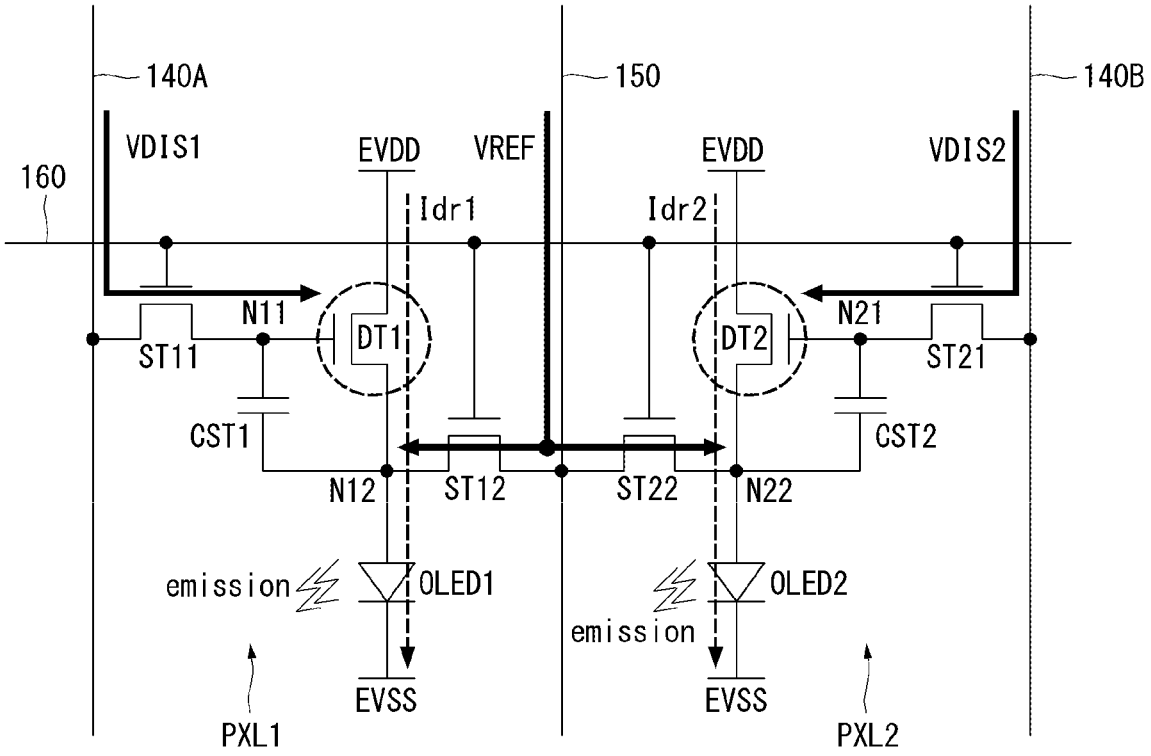

FIGS. 9A and 9B are views illustrating operations of the data driver and pixels during a first programming period during display driving for the first pixel and the second pixel. FIGS. 10A and 10B are views illustrating operations of the data driver and pixels during a second programming period and an emission period during display driving for the first pixel and the second pixel.

Display driving for the first pixel PXL1 and display driving for the second pixel PXL2 are performed concurrently or simultaneously. The display driving for the first and second pixels PXL1 and PXL2 are performed in order of the first programming period, the second programming period, and the emission period.

Referring to FIG. 9A, during the first programming period, the first connection switch SW1 and the second connection switch SW2 are turned off, the third connection switch SW3 and the fourth connection switch SW4 are floated, and the fifth connection switch SW5 is turned on. Accordingly, during the first programming period, the first amplifier AMP1 stops operating (e.g., the first amplifier AMP1 does not output a signal to either of the first or second data lines 140A, 140B), and the second amplifier AMP2 is configured as an output buffer outputting the reference voltage VREF generated in the DAC2 to the sensing line 150.

Referring to FIG. 9B, the reference voltage VREF output from the second amplifier AMP2 during the first programming period is applied to the second nodes N12 and N22 of the first and second pixels PXL1 and PXL2 through the sensing line 150 and through the second switching TFTs ST12, ST22 of the first and second pixels PXL1 and PXL2.

Referring to FIG. 10A, during the second programming period, the first connection switch SW1 and the second connection switch SW2 are turned off, the third connection switch SW3 is connected to the first data line 140A, the fourth connection switch SW4 is connected to the second data line 140B, and the fifth connection switch SW5 is turned on. Accordingly, during the second programming period, the first amplifier AMP1 is configured as an output buffer outputting the first display data voltage VDIS1 generated in the DAC1 to the first data line 140A, and the second amplifier AMP2 is configured as an output buffer outputting the second display data voltage VDIS2 generated in the DAC2 to the second data line 140B. The first and second display data voltages VDIS1, VDIS2 may be respectively generated by the DAC1 and DAC2 based on the digital image data CDATA that is corrected by the compensation IC 30, as previously described herein.

Referring to FIG. 10B, during the second programming period, the first display data voltage VDIS1 output from the first amplifier AMP1 is applied to the first node N11 of the first pixel PXL1 through the first data line 140A and through the first switching transistor ST11 of the first pixel PXL1. During the second programming period, the second display data voltage VDIS2 output from the second amplifier AMP2 is applied to the first node N21 of the second pixel PXL2 through the second data line 140B and through the first switching transistor ST21 of the second pixel PXL2.

Therefore, through the first and second programming periods, the gate-source voltage VDIS1-VREF of the driving TFT DT1 included in the first pixel PXL1 is set to a magnitude that turns on the driving TFT DT1 (i.e., a magnitude that allows the first pixel current Idr1 to flow), and the gate-source voltage VDIS2-VREF of the driving TFT DT2 included in the second pixel PXL2 is set to a magnitude that turns on the driving TFT DT2 (i.e., a magnitude that allows second pixel current Idr2 to flow).

During the emission period, the on/off states of the connection switches SW1 to SW5 are the same as those of the second programming period. During the emission period, the OLED1 emits light by the first pixel current Idr1 and the OLED2 emits light by the second pixel current Idr2.

As described above, the data driver provided in various embodiments of the present disclosure drives two data lines connected to two pixels and one sensing line connected in common to the two pixels with two amplifiers. In the related art, three amplifiers are required to drive three signal lines. In contrast, in the present disclosure, sensing driving and display driving are performed by driving three signal lines with two amplifiers through amplifier sharing. According to the present disclosure, the chip size and power consumption of the driver IC (D-IC) 20 are reduced.

In addition, the data driver provided in various embodiments of the present disclosure supplies the pixel off power supply voltage, which is further utilized for sensing driving, to the data lines. In the related art, the pixel off power supply voltage is generated through an amplifier, and the power consumption according to the amplifier operation is large. In contrast, in the present disclosure, since the data driver further includes the base power supply unit for supplying the pixel off power supply voltage, the consumption of power due to the amplifier operation may be minimized or reduced.

Although embodiments have been described, it should be understood that other modifications may be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the specific embodiments.

The invention claimed is:

1. A data driver, comprising:

an analog-to-digital converter;

a first amplifier circuit;

a first switch coupled to an output of the first amplifier circuit, the first switch configured to selectively couple the output of the first amplifier circuit to a first data line of a display panel and to selectively couple the output of the first amplifier circuit to a second data line of the display panel;

a second amplifier circuit;

a second switch coupled to an output of the second amplifier circuit, the second switch configured to selectively couple the output of the second amplifier circuit to the second data line and to selectively couple the output of the second amplifier circuit to the analog-to-digital converter; and a third switch coupled to the output of the second amplifier circuit, the third switch configured to selectively couple the output of the second amplifier circuit to a sensing line of the display panel wherein in a sensing driving mode, the output of the first amplifier circuit corresponds to a sensing data voltage to be supplied to a first pixel and a second pixel of the display panel, and the output of the second amplifier circuit corresponds to a reference voltage to be supplied to the first and second pixels, or sensing results of the first and second pixels according to a difference between the sensing data voltage and the reference voltage, and wherein the first pixel is connected to the first data line and the sensing line, and the second pixel is connected to the second data line and the sensing line.

2. The data driver of claim 1, further comprising:

a base power supply circuit;

a fourth switch coupled between the base power supply circuit and the first data line; and a fifth switch coupled between the base power supply circuit and the second data line.

3. The data driver of claim 2, wherein the base power supply circuit is configured to supply a pixel off voltage for turning off a pixel current in a pixel connected to the first data line or the second data line.

4. The data driver of claim 1, wherein the first amplifier circuit includes:

a first amplifier having an inverting input, a non-inverting input, and an output, the inverting input being connected to the output; and a first digital-to-analog converter connected to the non-inverting input of the first amplifier.

5. The data driver of claim 4, wherein the second amplifier circuit includes:

a second amplifier having an inverting input, a non-inverting input, and an output;

a second digital-to-analog converter connected to the non-inverting input of the second amplifier; and a feedback capacitor connected between the inverting input and the output of the second amplifier.

6. The data driver of claim 5, wherein the inverting input of the second amplifier is connected to the sensing line of the display panel.

7. A display device, comprising:

a display panel including:

a first pixel circuit;

a second pixel circuit adjacent to the first pixel circuit;

a first data line connected to the first pixel circuit;

a second data line connected to the second pixel circuit; and a sensing line connected to the first pixel circuit and the second pixel circuit; and a data driver coupled to the display panel, the data driver including:

a first amplifier circuit; and a second amplifier circuit, wherein the display device, in use, operates in a sensing driving mode and in a display driving mode, wherein in the sensing driving mode:

the first amplifier circuit outputs a sensing data voltage to the first data line during a first set-up period during sensing driving for the first pixel, and outputs the sensing data voltage to the second data line during a second set-up period during sensing driving for the second pixel, and the second amplifier circuit outputs a reference voltage to the sensing line during the first set-up period and the second set-up period, outputs a first sensing result of the first pixel during a first sampling period during sensing driving for the first pixel, and outputs a second sensing result of the second pixel during a second sampling period during sensing driving for the second pixel.

8. The display device of claim 7, wherein, in the sensing driving mode, the first sampling period occurs after the first set-up period, the second set-up period occurs after the first sampling period, and the second sampling period occurs after the second set-up period.

9. The display device of claim 7, wherein in the display driving mode:

the first amplifier circuit outputs a first display data voltage to the first data line, and the second amplifier circuit outputs a second display data voltage to the second data line.

10. The display device of claim 9, wherein, in the display driving mode, the second amplifier circuit outputs the second display voltage to the second data line at a same time as the first amplifier circuit outputs the first display data voltage to the first data line.

11. The display device of claim 9, wherein the data driver further includes:

an analog-to-digital converter;

a first switch coupled to the output of the first amplifier circuit, the first switch selectively couples the output of the first amplifier circuit to the first data line during the first set-up period and in the display driving mode, and selectively couples the output of the first amplifier circuit to the second data line during the second set-up period;

a second switch coupled to the output of the second amplifier circuit, the second switch selectively couples the output of the second amplifier circuit to the analog-to-digital converter during the first sampling period and the second sampling period, and selectively couples the output of the second amplifier circuit to the second data line in the display driving mode; and a third switch coupled to the output of the second amplifier circuit, the third switch selectively couples the output of the second amplifier circuit to the sensing line during the first set-up period and the second set-up period.

12. The display device of claim 11, further comprising:

a base power supply circuit configured to supply a pixel off voltage for turning off a pixel current in the first pixel circuit or the second pixel circuit;

a fourth switch coupled between the base power supply circuit and the first data line; and a fifth switch coupled between the base power supply circuit and the second data line.

13. The display device of claim 12, wherein the fourth switch selectively couples the base power supply circuit to the first data line during the second set-up period and the second sampling period, and the fifth switch selectively couples the base power supply circuit to the second data line during the first set-up period and the first sampling period.

14. The display device of claim 7, wherein the first amplifier circuit includes:

a first amplifier having an inverting input, a non-inverting input, and an output, the inverting input being connected to the output; and a first digital-to-analog converter connected to the non-inverting input of the first amplifier.

15. The display device of claim 14, wherein the second amplifier circuit includes:

a second amplifier having an inverting input, a non-inverting input, and an output;

a second digital-to-analog converter connected to the non-inverting input of the second amplifier; and a feedback capacitor connected between the inverting input and the output of the second amplifier.

16. The display device of claim 15, wherein the inverting input of the second amplifier is connected to the sensing line.

17. The display device of claim 11, further comprising:

a driver integrated circuit (IC) coupled to the display panel, wherein the driver IC includes the data driver; and a compensation integrated circuit (IC) coupled to the driver IC, the compensation IC being configured to receive digital sensing data output by the data driver, and correct image data received from a host system based on the digital sensing data.

18. The display device of claim 17, wherein the data driver further includes:

a base power supply circuit configured to supply a pixel off voltage for turning off a pixel current in the first pixel circuit or the second pixel circuit;

a fourth switch coupled between the base power supply circuit and the first data line; and a fifth switch coupled between the base power supply circuit and the second data line.

19. A data driver, comprising:

a first amplifier circuit selectively coupleable to a first data line of a first pixel and to second data line of a second pixel; and a second amplifier circuit selectively coupleable to the second data line and to a sensing line, wherein the data driver is operable in a sensing driving mode and in a display driving mode, wherein in the sensing driving mode:

the first amplifier circuit outputs a sensing data voltage to the first data line during a first set-up period during sensing driving for the first pixel, and outputs the sensing data voltage to the second data line during a second set-up period during sensing driving for the second pixel, and the second amplifier circuit outputs a reference voltage to the sensing line during the first set-up period and the second set-up period, outputs a first sensing result of the first pixel during a first sampling period during sensing driving for the first pixel, and outputs a second sensing result of the second pixel during a second sampling period during sensing driving for the second pixel.

20. The data driver of claim 19, wherein each of the first amplifier circuit and the second amplifier circuit includes only one amplifier.

* * * * *